US005575707A

United States Patent [19]

Talieh et al.

[11] Patent Number: 5,575,707

[45] Date of Patent: Nov. 19, 1996

[54] POLISHING PAD CLUSTER FOR POLISHING A SEMICONDUCTOR WAFER

[75] Inventors: Homayoun Talieh, San Jose; David E. Weldon, Los Gatos, both of Calif.

[73] Assignee: Ontrak Systems, Inc., Milpitas, Calif.

[21] Appl. No.: 321,169

[22] Filed: Oct. 11, 1994

[51] Int. Cl.[6] ..... B24B 7/22

[52] U.S. Cl. ..... 451/173; 451/168; 451/307

[58] Field of Search ..... 451/384, 388, 451/398, 402, 173, 41, 63, 307, 296, 285, 287, 289, 290, 548, 550

[56] References Cited

U.S. PATENT DOCUMENTS

| | | | |
|---|---|---|---|
| 3,654,739 | 4/1972 | Stoy et al. . | |
| 4,128,968 | 12/1978 | Jones | 451/41 |
| 4,601,134 | 7/1986 | Hessman | 451/303 |
| 4,802,309 | 2/1989 | Heynacher | 451/41 |
| 4,811,522 | 3/1989 | Gill, Jr. . | |
| 5,205,082 | 4/1993 | Shendon et al. . | |
| 5,212,910 | 5/1993 | Breivogel et al. . | |
| 5,230,184 | 7/1993 | Bukhman . | |
| 5,287,663 | 2/1994 | Pierce et al. . | |
| 5,297,361 | 3/1994 | Baldy et al. . | |
| 5,329,732 | 7/1994 | Karlsrud et al. . | |
| 5,329,734 | 7/1994 | Yu . | |
| 5,335,453 | 8/1994 | Baldy et al. . | |

FOREIGN PATENT DOCUMENTS

| | | | |
|---|---|---|---|
| 0118126A3 | 9/1984 | European Pat. Off. . | |
| 0478912A3 | 7/1991 | European Pat. Off. . | |
| 0796866 | 4/1936 | France | 451/550 |
| 59-014469 | 7/1982 | Japan . | |

OTHER PUBLICATIONS

"A New Pad and Equipment Development for ILD Planarization" by Toshiyasu Beppu, Motoyuki Obara and Yausuo Minamikawa, Semiconductor World, Jan., 1994, MY Mar. 17, 1994.

"Application of Chemical Mechanical Polishing to the Fabrication of VLSI Circuit Interconnections", William J. Patrick, William L. Guthrie, Charles L. Stadley and Paul M. Schiable, J. Electrochem. Soc., vol. 138, No. 6, Jun. 1991, pp. 1778–1784.

*Primary Examiner*—Robert A. Rose

*Attorney, Agent, or Firm*—Brinks Hofer Gilson & Lione

[57] ABSTRACT

A polishing pad cluster for polishing a semiconductor wafer having multiple integrated circuit dies includes a pad support and multiple polishing pads. Each pad has a polishing area substantially smaller than the wafer but not substantially smaller than an individual one of the integrated circuit dies. Each polishing pad is mounted to a respective polishing pad mount, which is in turn supported by the support. Each mount includes a respective joint having at least two degrees of freedom to allow the associated polishing pad to articulate with respect to the support to conform to the wafer. Each mount is substantially rigid in a direction perpendicular to the pad toward the pad support, and in some cases the adjacent mounts are completely isolated from one another. A magnet is used to bias the polishing pad against the wafer.

15 Claims, 3 Drawing Sheets

120
Y
118
X
118
112
116
120
114
110

210
222
C
W
218
212
218
214
216

220
DRIVE SYSTEM

POLISHING PAD CLUSTER FOR POLISHING A SEMICONDUCTOR WAFER

BACKGROUND OF THE INVENTION

This invention relates to the field of chemical mechanical polishing systems for semiconductor wafers of the type used in the fabrication of integrated circuits.

Integrated circuits are conventionally fabricated from semiconductor wafers, each containing an array of individual integrated circuit dies. It is important at various processing stages that the wafer be polished to a planar configuration. The present invention represents a new approach to the problem of such polishing.

Breivogel U.S. Pat. No. 5,212,910 discusses the problem of achieving local planarity at the integrated circuit die scale in a wafer that itself is to some extent curved. The Breivogel patent discloses a composite polishing pad that includes a base layer of a relatively soft elastic material, an intermediate rigid layer, and a top polishing pad layer. The intermediate rigid layer is segmented to form individual tiles, each having a size comparable to that of an integrated circuit die. In use, individual tiles press into the first resilient base layer as necessary to allow the respective polishing pad to conform to the non-planar wafer.

With this approach the individual tiles are not completely isolated from one another, because the resilient base layer extends between the tiles. Furthermore, the resilient base layer is designed to allow individual tiles to move in the Z direction, away from the wafer being polished. This approach may place unusual requirements on the polishing pad material.

The present invention is directed to a new approach which, to a large extent, overcomes the problems discussed above.

SUMMARY OF THE INVENTION

According to a first aspect of this invention, a polishing pad cluster is provided for polishing a semiconductor wafer comprising a plurality of integrated circuit dies. This cluster includes a pad support, and a plurality of polishing pads. Each pad has a polishing area substantially smaller than the wafer and not substantially smaller than an individual one of the integrated circuit dies. Multiple polishing pad mounts are provided, each coupled to a respective one of the polishing pads and supported by the support. Each mount comprises a respective joint comprising at least two degrees of freedom to allow the associated polishing pad to articulate with respect to the support to conform to the wafer. In some embodiments of this invention each mount is substantially rigid with respect to movement in a direction perpendicular to the respective pad toward the support. In other embodiments of this invention each mount is isolated from at least one adjacent mount, thereby decoupling adjacent polishing pads.

According to a second aspect of this invention, a polishing pad assembly for polishing a semiconductor wafer comprises a semiconductor wafer, at least one polishing pad supported on a ferromagnetic element, and at least one magnet. The wafer is positioned between the pad and the magnet such that magnetic forces produced by the magnet on the ferromagnetic element bias the pad against the wafer. Preferably, the magnet creates a non-uniform magnetic field across the wafer, which is selected to enhance planarization of the wafer.

DETAILED DESCRIPTION OF THE PRESENTLY PREFERRED EMBODIMENTS

Figure 1:
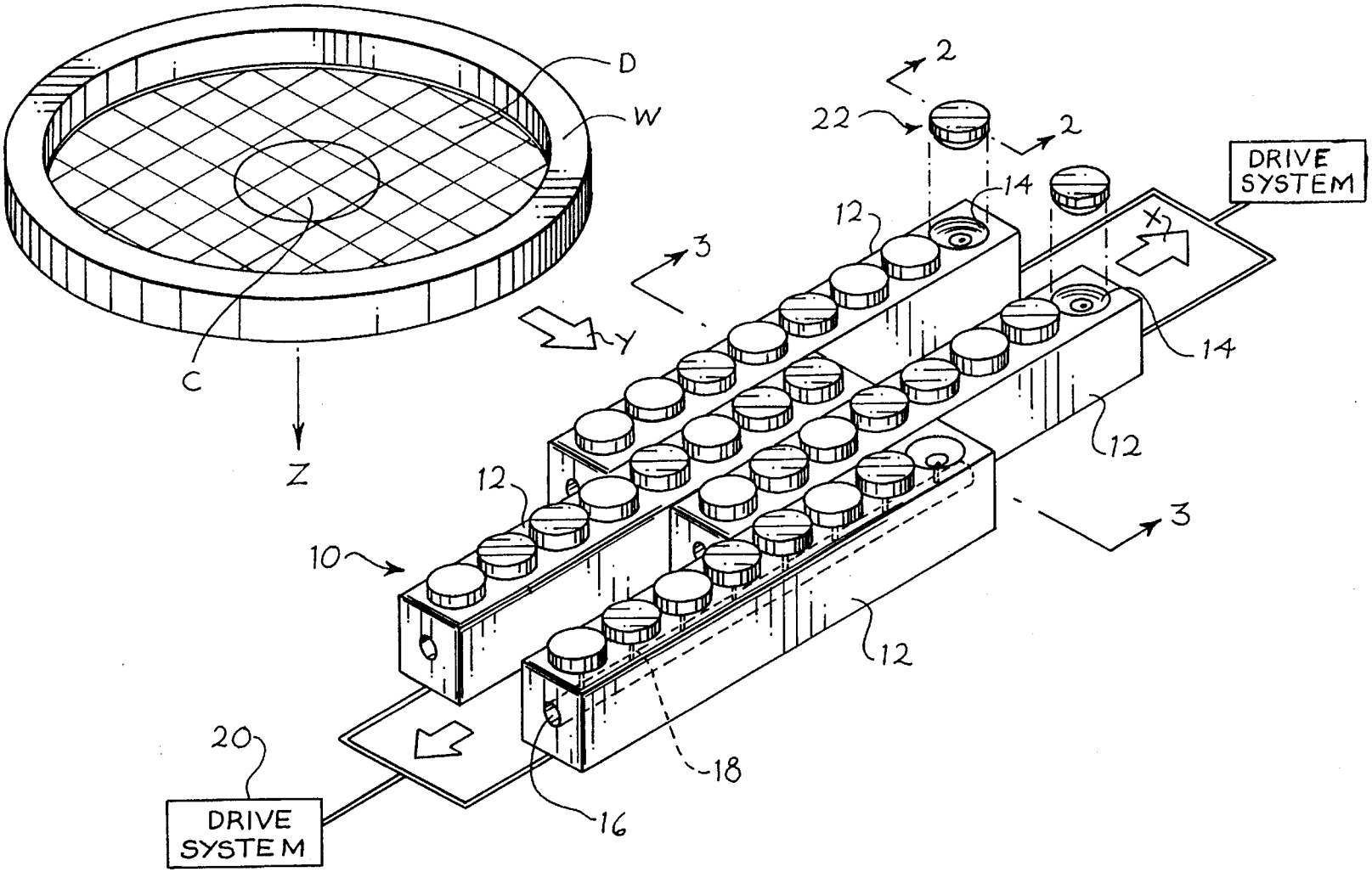
FIG. 1 is a perspective view of a first preferred embodiment of the polishing pad assembly of this invention.
Figure 2:
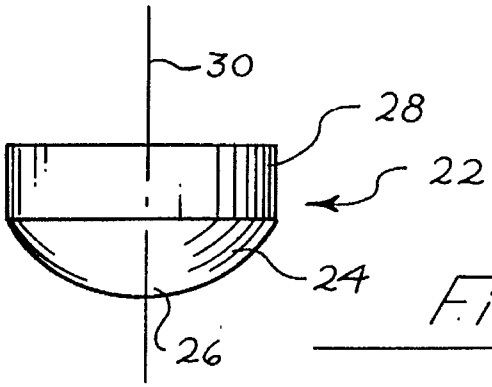
FIG. 2 is a cross-sectional view taken along line 2—2 of FIG. 1.
Figure 3:
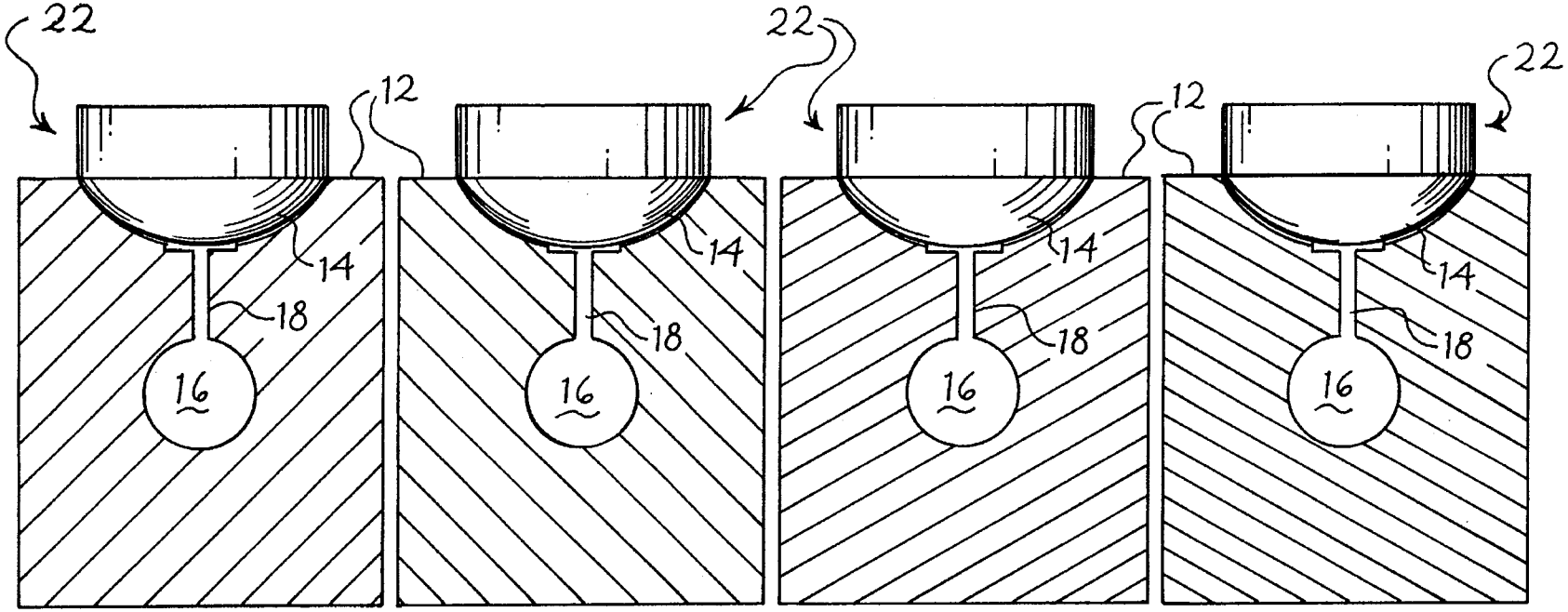
FIG. 3 is a cross-sectional view taken along line 3—3 of FIG. 1.

Turning now to the drawings, FIGS. 1, 2 and 3 relate to a first preferred embodiment 10 of the polishing pad assembly of this invention. The polishing pad assembly 10 is designed for use in chemical mechanical polishing of a wafer W that includes an array of integrated circuit dies D. Typically, the wafer W is mounted in a non-gimbaling wafer holder (not shown) which provides a polishing force in the downward or Z direction and rotates the wafer W about a center of rotation C. Additionally, the wafer holder moves the wafer W along a path transverse to the Z direction. Wafer holders of this type are well known to those skilled in the art and do not form part of this invention. They are not therefore described in detail here.

As shown in FIGS. 1 and 3, the polishing pad assembly 10 includes four pad supports 12 which are guided for movement along the X direction, and are substantially prevented from moving in either the Z direction or the Y direction.

Each pad support 12 defines an array of hemispherical recesses 14. Two of these recesses 14 are exposed at the right side of FIG. 1. Each of the pad supports 12 defines a lubricant manifold 16 which communicates with each of the recesses 14 by a respective lubricant passageway 18. Pressurized lubricant is supplied to the recesses 14 via the manifold 16 and the passageways 18 in order to ensure free articulation of the ball joints described below. If desired, the manifold 16 can be deleted and the passageways can be separately pressurized. The bearings for the recesses 14 are preferably hydrostatic fluid bearings as described below.

A drive system 20 reciprocates the pad supports 12 in the X direction. Those skilled in the art will recognize that a wide variety of mechanisms can be used for the drive system 20, including pneumatic, hydraulic and electrical drive systems. The pad supports 12 can be coupled directly to the respective actuators, or alternately a linkage such as a cam drive, a lead screw or a crank shaft can be used. Co-pending U.S. patent application Ser. No. 08/287,658, filed Aug. 9, 1994 ("Linear Polisher and Method for Semiconductor Wafer Planarization"), assigned to the assignee of the present invention, provides further details of suitable structures for the drive system 20, and this application is hereby incorporated by reference in its entirety.

The polishing pad assembly 10 also includes an array of polishing pad mounts 22, each comprising a respective ball joint 24. Each ball joint 24 defines a hemispherical bearing surface 26 which is shaped to fit with a respective recess 14. Each of the ball joints 24 has mounted at its upper surface a respective polishing pad 28. The polishing pad 28 has a selected thickness, and the bearing surface 26 is preferably shaped such that the center of rotation 30 of the ball joint 24 is positioned centrally on the surface of the polishing pad 28 that is in contact with the wafer W.

The ball joints 24 preferably are allowed to tilt by ±1° with respect to a centered position. A variety of materials and designs can be used for the ball joints 24. For example, both the bearing surface 26 and the recess 14 can be formed of a suitable ceramic. Lubricants that are used should preferably be compatible with the polishing slurry, and fluid bearings can be used as described in a related patent application identified as U.S. patent application Ser. No. 08/321,085, filed Oct. 11, 1994 and assigned to present invention. This application is filed on the same date as the present application and is hereby incorporated by reference in its entirety. Such fluid bearings have the advantage of being both rigid in the Z axis (for any given fluid pressure) yet easily adjustable in the range of 0.0001–0.002 inch in the Z direction (by adjusting fluid pressure).

Figure 4:
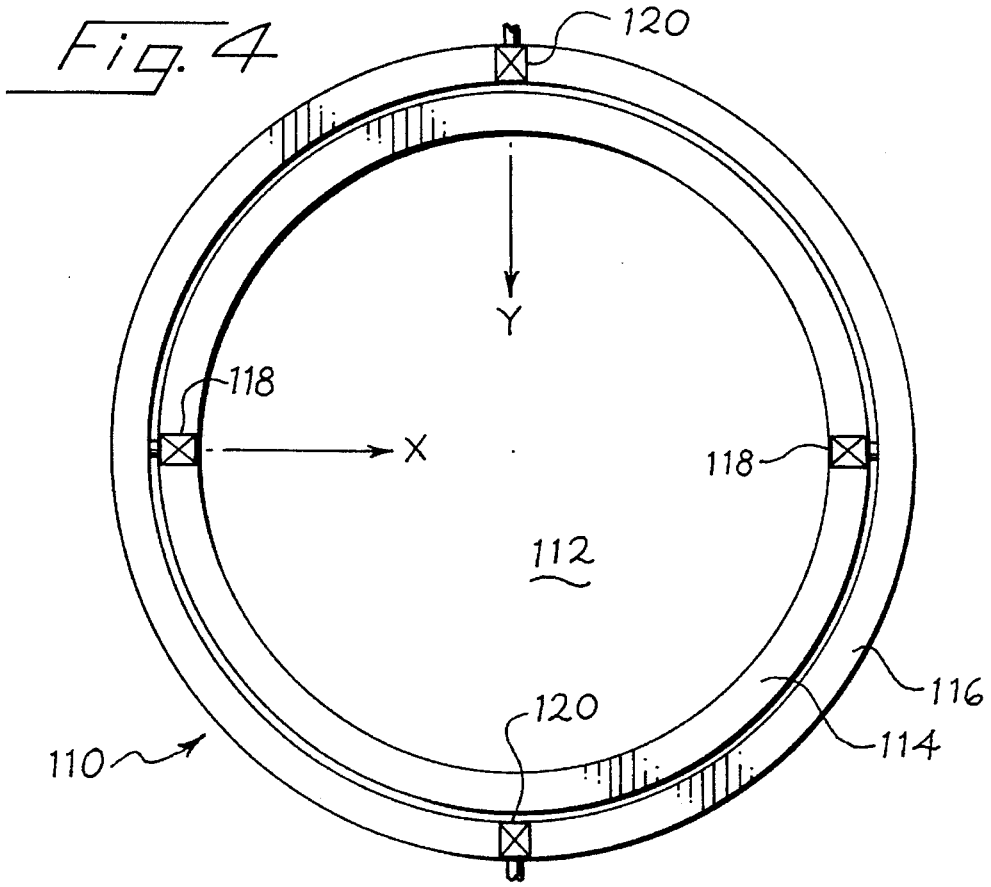
FIG. 4 is a top view of a cardan joint suitable for use with this invention.

If desired, the recesses 14 and the ball joints 24 can be replaced by cardan joints 110 as shown in FIG. 4. Each cardan joint 110 supports a polishing pad 112 on an inner ring 114. The inner ring 114 is mounted for rotation about the X axis by first bearings 118 which are secured to an outer ring 116. The outer ring 116 is mounted for rotation about the Y axis by second bearings 120 which support the outer ring 116 on a support.

Preferably, the cardan joint defines a maximum tilt angle of ±1.5° in both the X and Y directions, and the bearings 118, 120 can be formed as bushings, such as bronze bushings. The bearings 118, 120 are preferably sealed by elastomeric skirts and plugs to isolate them from the abrasive slurry.

A suitable cardan joint is described in a related patent application identified as U.S. patent application Ser. No. 08/321,086, filed Nov. 11, 1994, Assigned to the Assignee of the present invention. This application is hereby incorporated by reference in its entirety. This cardan joint does not place the center of rotation on the wafer surface being polished.

Both the polishing pads 28 and the polishing pads 112 define a pad area which is substantially less than that of the wafer W but not substantially less than that of a single integrated circuit die D. Preferably, the polishing pad area and shape are comparable to those of the die D, though of course other relationships are possible. The shape of an individual polishing pad can take the form of any polygon up to a circle, but the ideal shape for a polishing pad is identical in area and configuration to that of an individual die. Individual pads are separated from one another, but they are preferably situated closely adjacent to one another to provide a maximum polishing surface which results in a maximum material removal rate.

Because the joints 24, 110 are firmly and rigidly supported in the Z direction, the respective polishing pads 28, 112 are supported in the Z direction without excessive float. This provides the important advantage that conventional polishing pad materials can be used if desired. Conventional polyurethane polishing pad material having a hardness ranging from 52–62 Shore D and 50–80 Shore A is suitable, including the materials supplied by Rodel of Scottsdale, Arizona as polishing pad material IC1000 or SUBA IV. The thickness of the polishing pad 28, 112 can vary widely, depending upon the application. For example, the thickness of the pad can range from 0.005 inches to 0.5 inches. One suitable configuration utilizes a total pad thickness of 0.12 inches comprising IC1000. A thicker pad material may be appropriate because continuous pad conditioning may be desirable, and it therefore may be suitable to use a pad thickness between 0.25 and 0.5 inches.

The drive system 20 described above reciprocates the pad supports 12. It will be understood that the present invention is not limited to use with such drive systems. For example, the polishing pad clusters of this invention can if desired be used with conventional platens that are rotated about a central axis.

It should be noted that individual joints 24, 110 are completely isolated from one another. Each of the joints 24, 110 articulates about the X and Y axes, thereby allowing the respective polishing pad 28, 112 to position itself as appropriate to follow the non-planar contour of the wafer W. Because the joints 24, 110 are completely isolated from one another, articulation of one of the joints 24, 110 has no adverse effect on the position of an adjacent joint. Because the individual polishing pads 28, 112 are comparable in size to one of the dies D, excellent planarity of the dies D is obtained.

Figure 5:
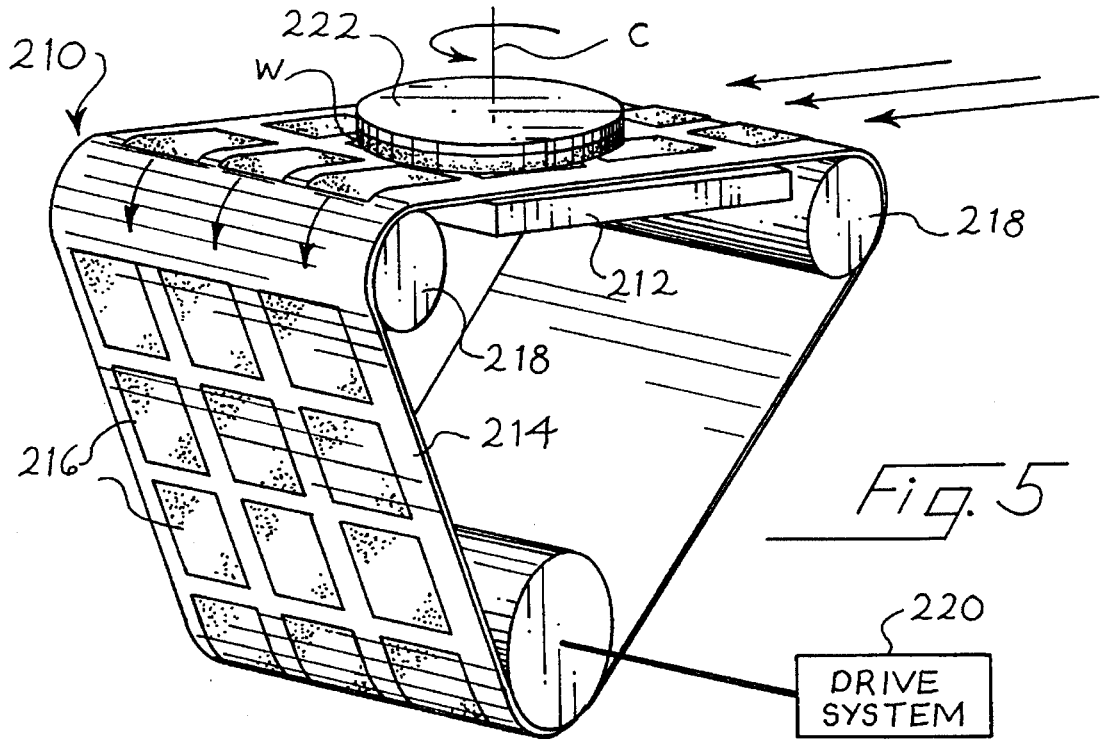
FIG. 5 is a perspective view of another preferred embodiment of this invention.

FIG. 5 relates to another preferred embodiment of this invention, which includes a polishing pad assembly 210. The assembly 210 includes a polishing pad support 212 which is rigidly positioned in space. A belt 214 is caused to move across the pad support 212 along the direction of the indicated arrows. The belt 214 supports an array of polishing pads 216 in a mosaic pattern. As described above, individual polishing pads 216 are preferably of the same size and shape as an individual die included in the wafer W, though other sizes and shapes are possible. The belt 214 forms a closed loop around a number of rollers 218, and one or more of these rollers 218 is driven in rotation by a drive system 220.

The above-identified U.S. patent application Ser. No. 08/287,658 provides further details regarding a preferred construction for the belt guiding and driving system. As is mentioned above, the entire disclosure of this application is hereby incorporated by reference.

The belt 214 is preferably formed of a ferromagnetic material such as an iron-based stainless steel. Any suitable thickness can be used, such as between 0.01 and 0.03 inches. The belt has sufficient flexibility to allow the individual pads 216 to articulate with respect to one another both in the X and Y directions due to flexure of the belt.

The wafer W is backed by a magnetic disk 222 that includes one or more magnets that generate a magnetic field. This magnetic field interacts with the belt 214 so as to urge the belt 214 and the polishing pads 216 toward the wafer W. Flexibility of the belt 214 allows individual ones of the polishing pads 216 to articulate and thereby to conform closely to the surface of the wafer W. The support 212 prevents the pads 216 from moving away from the wafer W, thereby providing a rigid limit position for the polishing pads 216 in the Z direction. If desired, the magnetic disk 222 can be designed to create a non-uniform magnetic field so as to provide polishing forces that vary across the wafer W. For example, in a situation where polishing rates tend to be greater near the periphery of the wafer W than near the center, the magnetic disk 222 can provide stronger magnetic forces near the center of the wafer W than near the periphery in order to make the polishing rate more nearly uniform across the wafer. A magnetic field that is stronger near the periphery than the center of the wafer is also possible.

It will of course be understood that the use of magnetic forces in the manner described is not confined to the belt embodiment of FIG. 5. Instead, a suitable magnet can be designed to interact with any ferromagnetic element in or behind a polishing pad. For example, a suitable magnet can interact with the ball joints 24 or the cardan joints 110 described above. Of course, both permanent magnets and electro-magnetic elements can be used to create the magnetic fields described above.

The speed of linear motion of the belt 214 can vary widely, for example in the range of 50–200 feet per minute. Conventional slurries can be used, including water based slurries.

It should be apparent from the foregoing description that the preferred embodiments described above provide a number of important advantages. First, since the joints are isolated from one another and rigidly supported in the Z direction, a wide variety of polishing pad materials, including conventional polishing pad materials, can easily be used. A wide range of materials from polyurethane to glass can be used, though of course in the embodiment of FIG. 5 the pad material should be sufficiently flexible to bend around the rollers.

This invention is not limited to the preferred embodiments described above, and a wide variety of articulating joints can be used, including magnetically supported, hydrostatically supported and fluid bladder supported joints. The invention can be used with both linear motion polishing systems and rotary motion polishing systems, and the magnetic assembly described above can be used both with clusters of polishing pads as described above, as well as with conventional polishing pads that are larger than the wafer.

It is therefore intended that the foregoing detailed description be regarded as illustrative rather than limiting, and that it be understood that it is the following claims, including all equivalents, which are intended to define the scope of this invention.

We claim:

1. A polishing pad cluster for polishing a semiconductor wafer comprising a plurality of integrated circuit dies, said cluster comprising:

a pad support;

a plurality of polishing pads, each pad having a polishing area substantially smaller than the wafer and substantially the same area as an individual one of the integrated circuit dies; and a plurality of polishing pad mounts, each mount coupled to a respective one of the polishing pads and supported by the support, each mount comprising a respective joint comprising at least two degrees of freedom to allow the associated polishing pad to articulate with respect to the support to conform to the wafer, each mount being substantially rigid in a direction perpendicular to the respective pad toward the pad support.

2. A polishing pad cluster for polishing a semiconductor wafer comprising a plurality of integrated circuit dies, said cluster comprising:

a pad support;

a plurality of polishing pads, each pad having a polishing area substantially smaller than the wafer and substantially the same area as an individual one of the integrated circuit dies; and a plurality of polishing pad mounts, each mount isolated from at least one adjacent mount, coupled to a respective one of the polishing pads, and supported by the support, each mount comprising a respective joint comprising at least two degrees of freedom to allow the associated polishing pad to articulate with respect to the support to conform to the wafer.

3. The invention of claim 1 or 2 wherein each of the joints comprising a respective ball joint.

4. The invention of claim 1 or 2 wherein each of the joints comprises a respective cardan joint.

5. A polishing pad cluster for polishing a semiconductor wafer comprising a plurality of integrated circuit dies, said cluster comprising:

a pad support;

a plurality of polishing pads, each pad having a polishing area substantially smaller than the wafer and not substantially smaller than an individual one of the integrated circuit dies; and a plurality of polishing pad mounts, each mount coupled to a respective one of the polishing pads and supported by the support, each mount comprising a respective joint comprising at least two degrees of freedom to allow the associated polishing pad to articulate with respect to the support to conform to the wafer, each mount being substantially rigid in a direction perpendicular to the respective pad toward the pad support;

wherein the joints are formed by a layer of a substantially incompressible material supported rigidly by the pad support against movement away from the wafer.

6. The invention of claim 5 wherein the layer of flexible material comprises a belt, and wherein the pads are mounted on the belt in a mosaic pattern.

7. A polishing pad cluster for polishing a semiconductor wafer comprising a plurality of integrated circuit dies, said cluster comprising:

a pad support;

a plurality of polishing pads, each pad having a polishing area substantially smaller than the wafer and not substantially smaller than an individual one of the integrated circuit dies; and a plurality of polishing pad mounts, each mount coupled to a respective one of the polishing pads and supported by the support, each mount comprising a respective joint comprising at least two degrees of freedom to allow the associated polishing pad to articulate with respect to the support to conform to the wafer, each mount being substantially rigid in a direction perpendicular to the respective pad toward the pad support;

at least one magnet, the semiconductor wafer positioned between the magnet and the polishing pads, at least some of said joints and said polishing pads comprising ferromagnetic material such that the magnet biases the polishing pads against the wafer.

8. A polishing pad cluster for polishing a semiconductor wafer comprising a plurality of integrated circuit dies, said cluster comprising:

a pad support;

a plurality of polishing pads, each pad having a polishing area substantially smaller than the wafer and not substantially smaller than an individual one of the integrated circuit dies; and a plurality of polishing pad mounts, each mount isolated from at least one adjacent mount, coupled to a respective one of the polishing pads, and supported by the support, each mount comprising a respective joint comprising at least two degrees of freedom to allow the associated polishing pad to articulate with respect to the support to conform to the wafer;

at least one magnet, the semiconductor wafer positioned between the magnet and the polishing pads, at least some of said joints and said polishing pads comprising ferromagnetic material such that the magnet biases the polishing pads against the wafer.

9. The invention of claim 1 or 2 wherein the polishing areas and the individual integrated circuit dies are of substantially the same shape.

10. The invention of claim 1 or 2 wherein the polishing areas and the individual circuit dies are of substantially identical area and configuration.

11. The invention of claim 1 or 2 further comprising means for moving the polishing pads linearly with respect to the pad support.

12. The invention of claim 7 or 8 wherein the at least one magnet creates a non-uniform magnetic field across the wafer, said field selected to enhance planarization of the wafer.

13. A polishing pad assembly for polishing a semiconductor wafer, said assembly comprising:

a semiconductor wafer;

at least one polishing pad supported on a ferromagnetic element; and at least one magnet;

said wafer positioned between the pad and the magnet such that magnetic forces produced by the magnet on the ferromagnetic element bias the pad against the wafer.

14. The invention of claim 13 wherein the at least one magnet creates a non-uniform magnetic field across the wafer, said field selected to enhance planarization of the wafer.

15. The invention of claim 13 wherein the at least one magnet creates a non-uniform magnetic field across the wafer, said field being weaker at a peripheral portion of the wafer than at a central portion of the wafer.

* * * * *